US011730253B1

(12) United States Patent
Lloyd

(10) Patent No.: US 11,730,253 B1
(45) Date of Patent: Aug. 22, 2023

(54) SANITARY COSMETIC BRUSH CONTAINER

(71) Applicant: Sharon Lloyd, Winter Park, FL (US)

(72) Inventor: Sharon Lloyd, Winter Park, FL (US)

( * ) Notice: Subject to any disclaimer, the term of this patent is extended or adjusted under 35 U.S.C. 154(b) by 143 days.

(21) Appl. No.: 17/479,982

(22) Filed: Sep. 20, 2021

(51) Int. Cl.
*A45D 44/18* (2006.01)

(52) U.S. Cl.
CPC ..... *A45D 44/18* (2013.01)

(58) Field of Classification Search
CPC ..... A45D 44/18; A47K 1/09; A45C 11/008; Y10S 206/804; B65D 83/005
USPC ..... 206/362, 817, 362.1, 804; 312/206; 132/308
See application file for complete search history.

(56) References Cited

U.S. PATENT DOCUMENTS 1,566,860 A * 12/1925 Hainzigianis ..... A47K 1/09 312/312
1,573,158 A * 2/1926 Gilchrist ..... A47F 1/04 261/119.1
1,584,261 A * 5/1926 Vuolo ..... A45D 44/18 206/362.1
2,487,107 A * 11/1949 Dandrea ..... B65D 83/005 211/49.1
3,727,748 A * 4/1973 Brown ..... A47K 1/09 206/362.1
4,845,859 A * 7/1989 Evans ..... A47K 1/09 34/107
5,630,505 A * 5/1997 Garcia ..... A45D 44/18 206/362.1
6,135,279 A * 10/2000 Dryer ..... A46B 17/06 206/362.1
6,193,059 B1 * 2/2001 Massaro ..... A47K 11/10 206/394
7,387,204 B2 6/2008 Lee
2009/0200184 A1 * 8/2009 Cullen ..... A47K 1/09 206/362.2

* cited by examiner

*Primary Examiner* — Chun Hoi Cheung
(74) *Attorney, Agent, or Firm* — Sanchelima & Associates, P.A.; Christian Sanchelima; Jesus Sanchelima

(57) ABSTRACT

A container for storing and drying cosmetic brushes includes an enclosed container with a hinged top cover. Furthermore, a mesh filter is located on the top of the container and multiple suction cups are mounted on interior brush holders wherein the brushes are inserted into the container and kept in a sanitary environment while drying. The filter prevents air from entering the container which may contain dust and germs. In another embodiment, the top cover is provided as a pull-out top cover. In yet another embodiment, the top cover is provided as a screw-on cover.

9 Claims, 5 Drawing Sheets

SANITARY COSMETIC BRUSH CONTAINER

BACKGROUND OF THE INVENTION

1. Field of the Invention

The present invention relates to a sanitary brush container and, more particularly, to a sanitary cosmetic brush container that includes a mesh filter at the top of the container to maintain the brushes in a sanitary environment while drying.

2. Description of the Related Art

Several designs for a brush container have been designed in the past. None of them, however, include a container for storing and drying cosmetic brushes having an enclosed container with a hinged top cover. Furthermore, a mesh filter is located on the top of the container and multiple suction cups are mounted on interior brush holders. The brushes are inserted into the container and kept in a sanitary environment while drying, which the filter prevents air from entering the container that may contain dust and germs. In another embodiment, the top cover is provided as a pull-out top cover. In yet another embodiment, the top cover is provided as a screw-on cover.

Applicant believes that a related reference corresponds to U.S. Pat. No. 7,387,204 issued for a cosmetic brush container with a pull-up tray and a lower compartment for an antimicrobial bag to combat bacteria on brushes. Applicant believes that another related reference corresponds to U.S. Pat. No. 6,135,279 issued for a toothbrush holder with a sanitizing fluid. However, the cited references differ from the present invention because the fail to disclose the mesh filter with the different lid combinations.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a sanitary cosmetic brush container that provides an improved way to store and protect makeup brushes and protects against dust, dirt, debris, germs, bacteria, pollutants, etc.

It is another object of this invention to provide a sanitary cosmetic brush container that is designed to accommodate and conform to fit any shape brush handle to increase organization.

It is still another object of the present invention to provide a sanitary cosmetic brush container that enhances sanitation and is ideal for anyone that uses cosmetic brushes.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
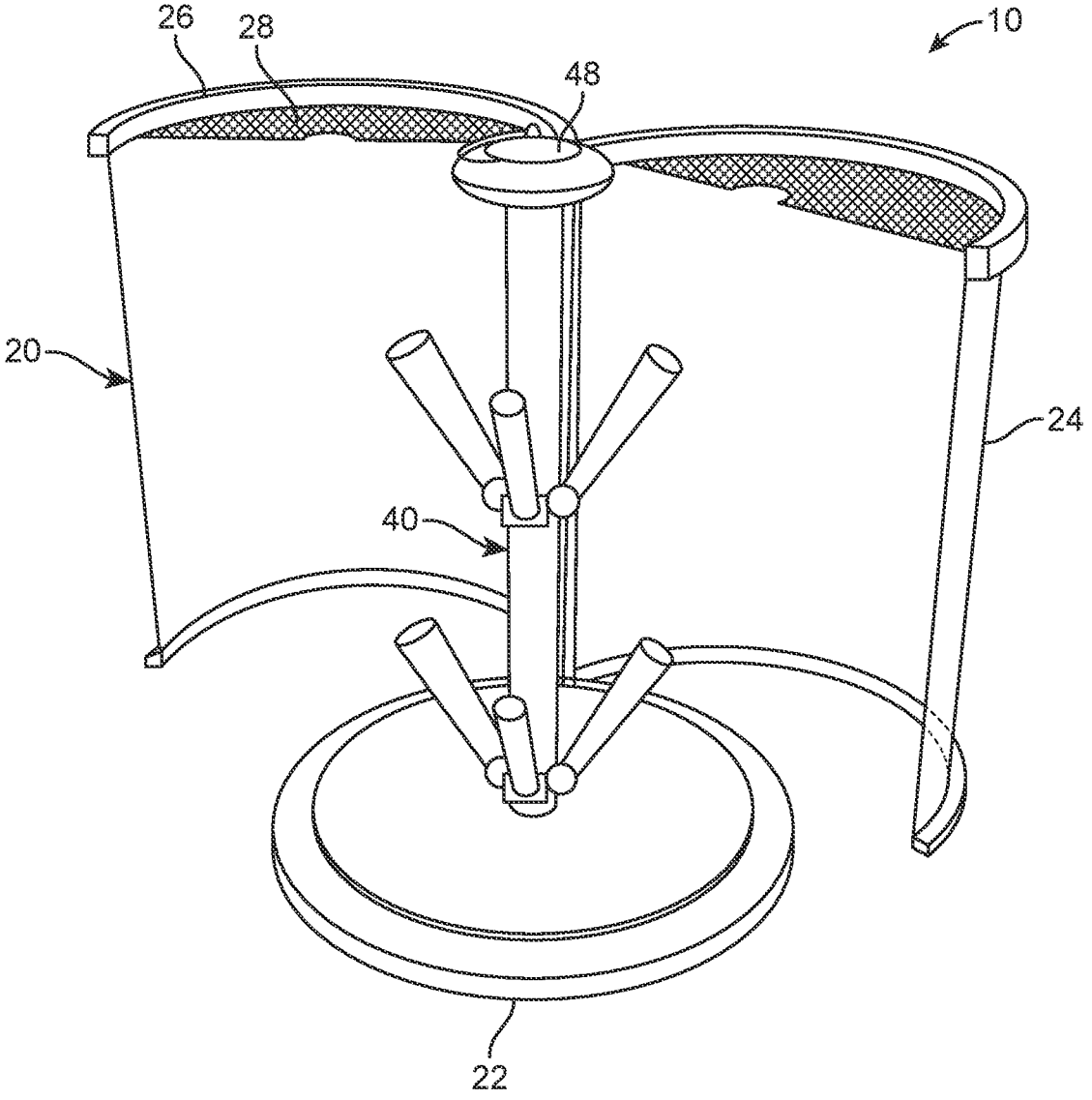
FIG. 1 represents an operational isometric view of sanitary container 10 including a housing assembly 20 and a stem assembly 40 in accordance with an embodiment of the present invention.

Referring now to the drawings, where the present invention is generally referred to with numeral 10, it can be observed a system for a cosmetic container 10 which basically includes a housing assembly 20 and a stem assembly 40.

Housing assembly 20 can be observed in FIG. 1 of the provided drawings. Housing assembly 20 includes a base 22 disposed at a bottom most end of the assembly thereof. In the present embodiment, base 22 may be provided as a circular base. It should be appreciated that other embodiments of the present invention could feature a base having a variety of other shapes. Furthermore, base 22 could also be made of a plastic material or any other suitable material. Housing assembly 20 further includes sidewall 24 which extends upright from the base 22. In the present embodiment, sidewall 24 extends about the entire circumference of base 22 and is provided as being normal to the base thereby forming a cylindrical housing. Additionally, sidewall 24 may be made of a transparent or translucent material such that a user may observe the contents that are within the housing. It should be appreciated that other embodiments of the invention may feature sidewall 24 being made of an opaque material. In one embodiment, the sidewall 24 can include a hinged configuration such that it hingedly opens from a front end as observed in FIG. 1.

Housing assembly 20 further includes a lip 26 as observed in FIG. 1 of the drawings. In the present embodiment, lip 26 is disposed on the topmost end of the sidewall 24. Lip 26 is provided as a circular structural ring member that extends about the entire circumference of the sidewall 24. Additionally, lip 26 may extend beyond the sidewall 24. Positioned within the inner portion of the lip 26 is a mesh filter 28. In the present embodiment, mesh filter 28 is provided as woven metal wire or plastic strands which stops particles that are too large from passing through openings in the mesh. Mesh filter 28 is a surface filtration type of material since particles are captured on the surface of the mesh. In the present embodiment, mesh filter 28 conforms to the shape of the interior of the ring of lip 26 and prevents any airborne germs from entering the housing.

Figure 2:
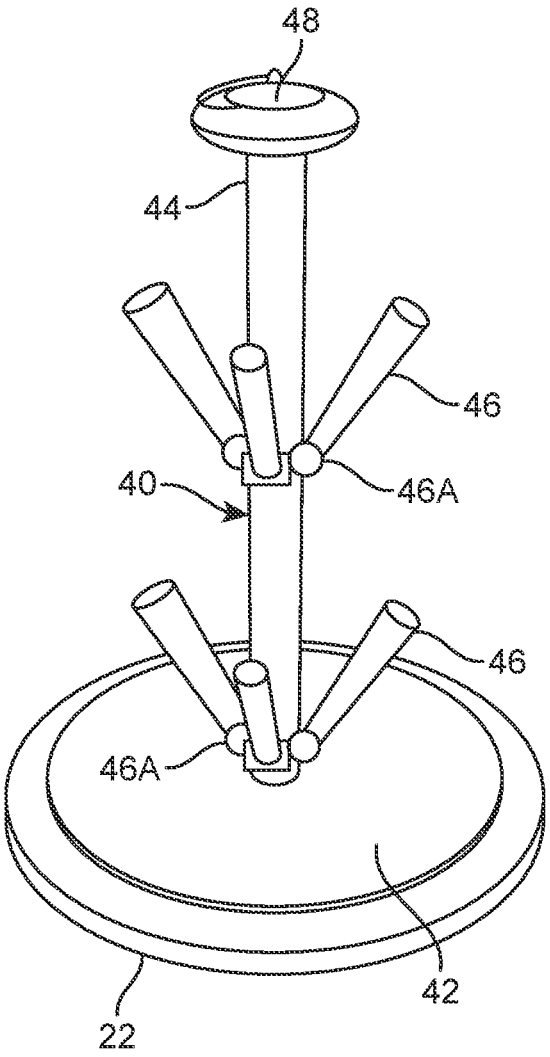
FIG. 2 shows an isometric view of stem assembly 40 in accordance with an embodiment of the present invention.

Stem assembly 40 can be observed in FIG. 2 of the provided drawings. Stem assembly 40 includes a stem base 42 which is layered onto the base 22 of the housing assembly 20. In the present embodiment, stem base 42 is circular in shape and includes a diameter that is less than a diameter of the base 22. It can be appreciated that other embodiments may feature a stem base 42 which includes a shape that is different from a circle. Stem assembly 40 further includes a stem 44 which extends upright from the stem base 42. In one embodiment, the stem 44 is a cylindrical structure which is normal to the stem base 42.

In the present embodiment, a plurality of holders 46 are secured to the stem 44 of the stem assembly 40. In one implementation, the plurality of holders 46 are each hollow conical members which are affixed to the stem 44. The plurality of holders 46 are configured to hold cosmetic brushes in one embodiment. The brushes are inserted into the hollow portion of each of the holders. The plurality of holders 46 each include a suction cup 46A at a distal end. The suction cup 46A is coupled to the stem 44 to form a secure abutting engagement thereon. The present embodiment features two rows of holders 46 on the stem 44. However, it should be appreciated that any number of holders 46 can be positioned on the stem 44.

In the present embodiment, the topmost end of the stem 44 includes a handle 48. Handle 48 may be provided as a circular structural member affixed to the stem 44. In one implementation, handle 48 further includes a ring hook that may utilized by a user carry the housing. In the present embodiment, the lip 26, the mesh filter 28, and the handle 48 forms a top cover.

Figure 3:
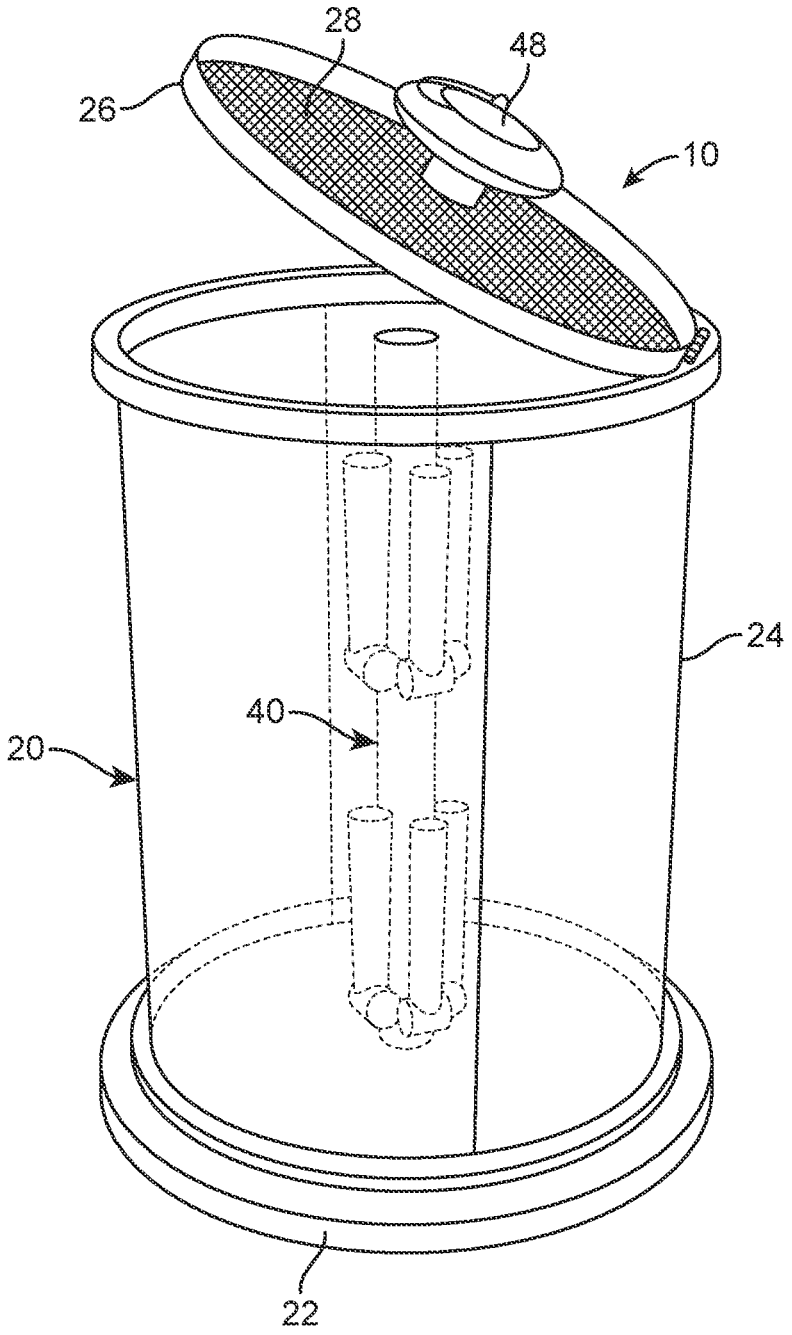
FIG. 3 illustrates an isometric view of sanitary container 10 with housing assembly 20 implementing a hinged top cover in accordance with an embodiment of the present invention.
Figure 4:
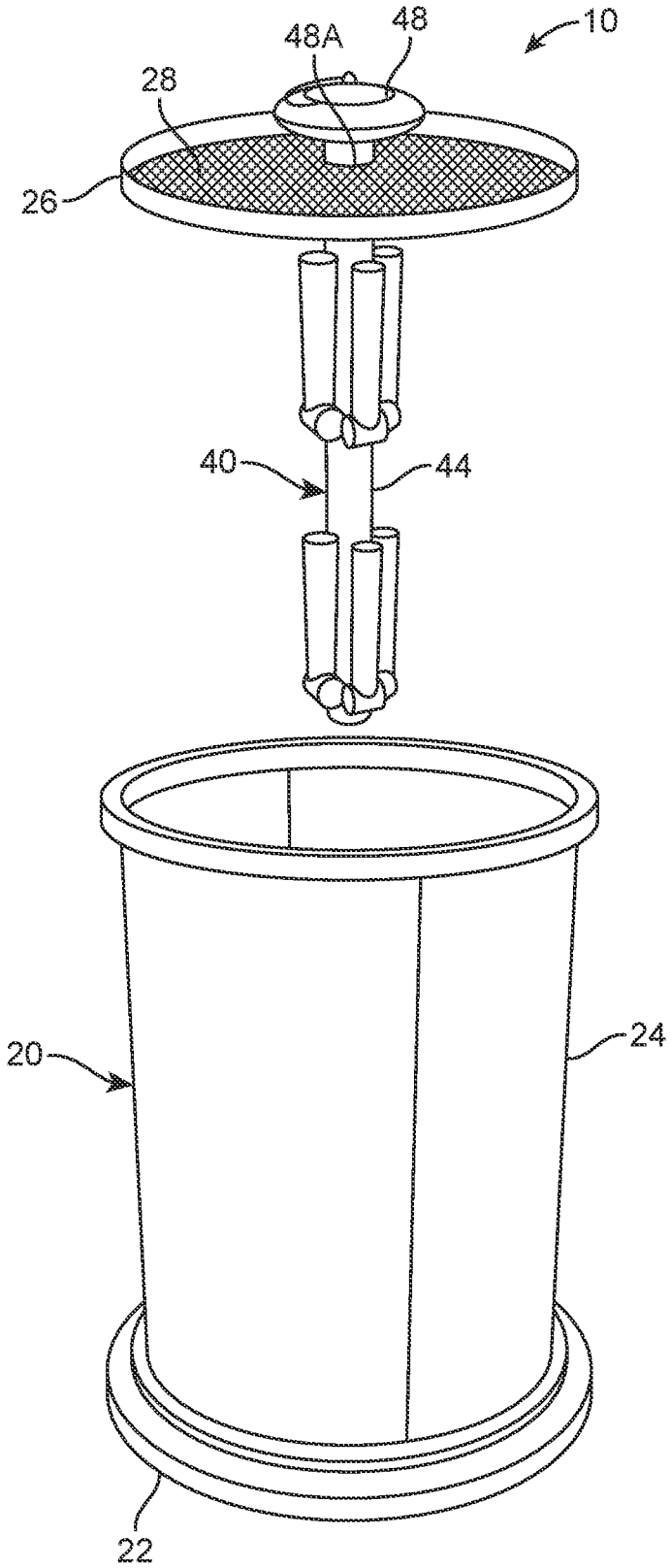
FIG. 4 is a representation of an isometric view of sanitary container 10 with housing assembly 20 implementing a pull-out top cover in accordance with another embodiment of the present invention.
Figure 5:
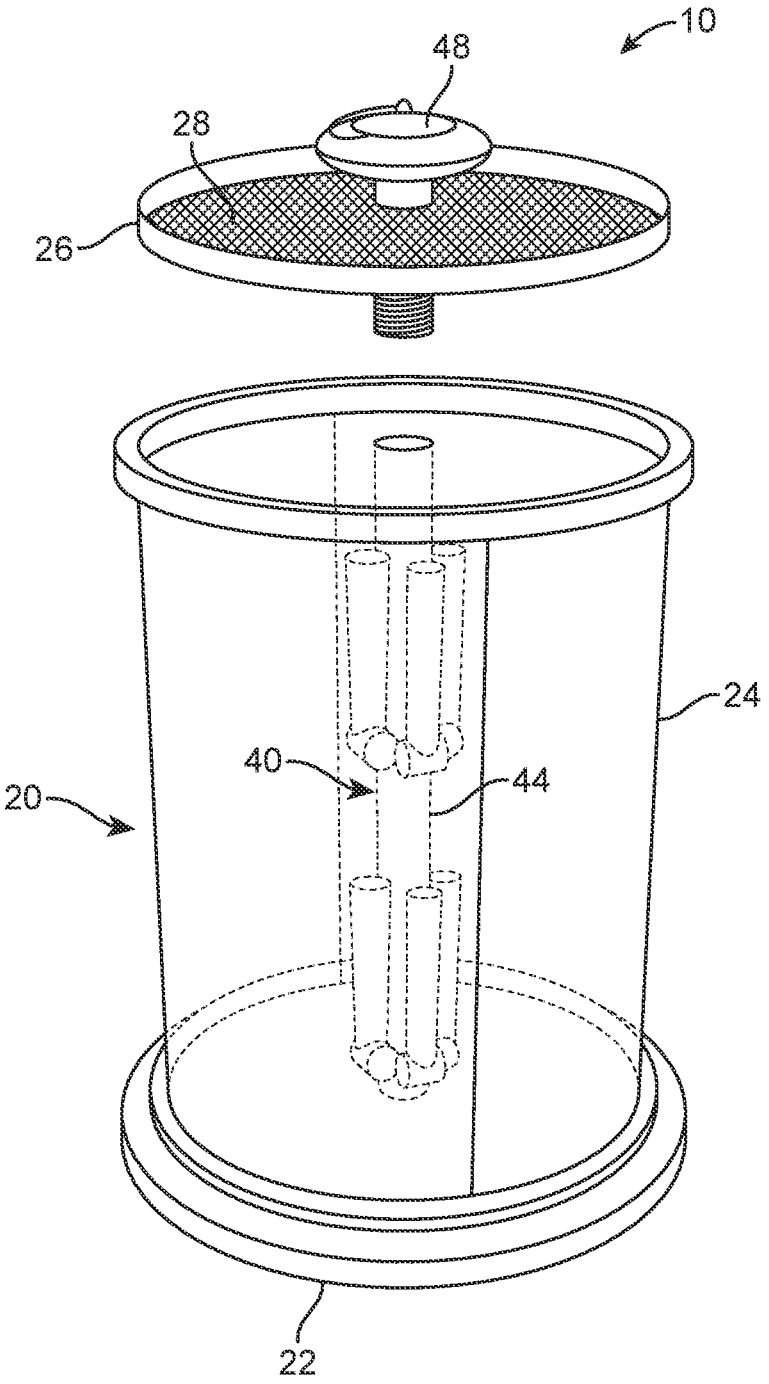
FIG. 5 shows an isometric view of sanitary container 10 with housing assembly 20 implementing a screw-on top cover in accordance with yet another embodiment of the present invention.

FIG. 3 depicts a first embodiment of the present invention. The top cover of the cosmetic container is hingedly mounted to the topmost end of the sidewall. FIG. 4 depicts a second embodiment of the present invention. In the second embodiment, the stem 44 is abuttingly affixed to the bottom end of the top cover to form one structure. The top cover with the stem is then removable from the housing to provide access to the holders. FIG. 5 depicts a third embodiment of the present invention where a bottom portion of the top cover includes a threaded member that is threadably inserted into a top end of the stem. The top cover may then be threadably removed from the housing to provide access to the interior therein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a sanitary container, comprising:
   a. a housing assembly including a base defining a bottom end, a sidewall extending upright from the base defining a container, said sidewall extending about an entire perimeter of the base, wherein a topmost end of the sidewall includes a lip, wherein an interior of the lip includes a mesh filter disposed thereon; and
   b. a stem assembly including a stem base layered on the base of the housing assembly, said stem assembly including a stem extending normal from the stem base, wherein a plurality of holders is affixed to the stem, wherein said stem assembly further includes a handle positioned entirely above the mesh filter, wherein each plurality of holders includes a suction cup member at a distal end to affix the plurality of holders to the stem.

2. The system for a sanitary container of claim 1 wherein said base is circular in shape, said sidewall being cylindrical in shape.

3. The system for a sanitary container of claim 1 wherein said sidewall is a transparent or translucent sidewall.

4. The system for a sanitary container of claim 1 wherein said lip is a circular ring member.

5. The system for a sanitary container of claim 1 wherein said mesh filter is provided as woven metal wire or plastic strands adapted to stop particles that are too large from passing through openings in the mesh filter.

6. The system for a sanitary container of claim 1 wherein said plurality of holders each have a conical shape.

7. The system for a sanitary container of claim 1 wherein said handle includes a ring hook at a top most end.

8. A system for a sanitary container, comprising:
   a. a housing assembly including a base defining a bottom end, a sidewall extending upright from the base defining a container, said sidewall extending about an entire perimeter of the base, wherein a topmost end of the sidewall includes a lip, wherein an interior of the lip includes a mesh filter disposed thereon; and
   b. a stem assembly including a stem base layered on the base of the housing assembly, said stem assembly including a stem extending normal from the stem base, wherein a plurality of holders are affixed to the stem, wherein each of the plurality of holders have a conical shape, wherein said stem includes two rows of said plurality of holders affixed thereon, wherein each of the plurality of holders include a suction cup member at a distal end, wherein the suction cup member is abuttingly coupled to sides of the stem to form a mounted engagement, wherein said stem assembly further includes a handle positioned entirely above the mesh filter.

9. A system for a sanitary container, consisting of:
   a. a housing assembly including a base defining a bottom end, wherein said base is circular in shape, a sidewall extending upright from the base defining a container forming a cylindrical container, said sidewall extending about an entire perimeter of the base, wherein said sidewall is made of a transparent or translucent material, wherein a topmost end of the sidewall includes a lip, said lip being a circular ring, wherein an interior of the lip includes a mesh filter disposed thereon, said mesh filter being provided as woven metal wire or plastic strands adapted to stop particles that are too large from passing through openings in the mesh filter; and
   b. a stem assembly including a stem base layered on the base of the housing assembly, said stem assembly including a stem extending normal from the stem base, wherein a plurality of holders are affixed to the stem, wherein each of the plurality of holders have a conical shape, wherein said stem includes two rows of said plurality of holders affixed thereon, wherein each of the plurality of holders include a suction cup member at a distal end, wherein the suction cup member is abuttingly coupled to sides of the stem to form a mounted engagement, wherein said stem assembly further includes a handle positioned entirely above the mesh filter, wherein the handle includes a ring hook coupled to a top most end.

* * * * *